US010698327B2

(12) United States Patent
Nagashima et al.

(10) Patent No.: US 10,698,327 B2
(45) Date of Patent: Jun. 30, 2020

(54) TONER

(71) Applicant: CANON KABUSHIKI KAISHA, Tokyo (JP)

(72) Inventors: Yuujirou Nagashima, Susono (JP); Yusuke Hasegawa, Suntou-gun (JP); Tomohisa Sano, Mishima (JP); Yoshitaka Suzumura, Mishima (JP); Satoshi Arimura, Toride (JP); Kozue Uratani, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/260,210

(22) Filed: Jan. 29, 2019

(65) Prior Publication Data

US 2019/0155181 A1 May 23, 2019

Related U.S. Application Data

(63) Continuation of application No. 15/361,583, filed on Nov. 28, 2016, now Pat. No. 10,228,627.

(30) Foreign Application Priority Data

Dec. 4, 2015 (JP) ..... 2015-237856
Sep. 7, 2016 (JP) ..... 2016-174568

(51) Int. Cl.

| | |
|---|---|
| ***G03G 9/09*** | (2006.01) |
| ***G03G 9/083*** | (2006.01) |
| ***G03G 9/087*** | (2006.01) |
| ***G03G 9/08*** | (2006.01) |

(52) U.S. Cl.
CPC ..... *G03G 9/0833* (2013.01); *G03G 9/0804* (2013.01); *G03G 9/0821* (2013.01); *G03G 9/0827* (2013.01); *G03G 9/0838* (2013.01); *G03G 9/0839* (2013.01); *G03G 9/08711* (2013.01); *G03G 9/08755* (2013.01); *G03G 9/08782* (2013.01); *G03G 9/08797* (2013.01);
(Continued)

(58) Field of Classification Search
CPC ..... G03G 9/08755; G03G 9/08708
See application file for complete search history.

(56) References Cited

U.S. PATENT DOCUMENTS

| | | | |
|---|---|---|---|
| 6,586,151 | B1 | 7/2003 | Naka et al. |
| 6,803,164 | B2 | 10/2004 | Mizoo et al. |
| 6,953,646 | B2 | 10/2005 | Doujo et al. |

(Continued)

FOREIGN PATENT DOCUMENTS

| | | |
|---|---|---|
| CN | 103189804 | 7/2013 |
| CN | 104395836 | 3/2015 |

(Continued)

OTHER PUBLICATIONS

Translation of JP 2003-302791 published Oct. 2003.*

*Primary Examiner* — Peter L Vajda
(74) *Attorney, Agent, or Firm* — Venable LLP

(57) ABSTRACT

Provided is a toner containing a toner particle including a binder resin, a wax, and a colorant. The softening point of the toner is at least 80° C. and not more than 140° C. The average circularity of the toner is at least 0.940. The integrated value of stress in the toner at 150° C. which is measured by using a tackiness tester is at least 78 g·m/sec.

7 Claims, 1 Drawing Sheet

(52) U.S. Cl.
CPC ..... *G03G 9/0902* (2013.01); *G03G 9/0926* (2013.01)

(56) References Cited

U.S. PATENT DOCUMENTS

| | | | |
|---|---|---|---|
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,040,216 | B2 | 5/2015 | Fukudome et al. |
| 9,097,997 | B2 | 8/2015 | Nomura et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,377,708 | B2 | 6/2016 | Magome et al. |
| 9,417,542 | B2 | 8/2016 | Hiroko et al. |
| 9,423,710 | B2 | 8/2016 | Magome et al. |
| 9,423,711 | B2 | 8/2016 | Uratani et al. |
| 9,442,416 | B2 | 9/2016 | Magome et al. |
| 9,454,096 | B2 | 9/2016 | Hasegawa et al. |
| 9,804,514 | B2 | 10/2017 | Suzumura et al. |
| 9,841,692 | B2 | 12/2017 | Hasegawa et al. |
| 9,946,179 | B2 | 4/2018 | Arimura et al. |
| 9,964,874 | B2 | 5/2018 | Suzumura et al. |
| 2009/0197192 | A1 | 8/2009 | Hiroko et al. |
| 2010/0151377 | A1* | 6/2010 | Uchino ..... G03G 9/0825 430/110.2 |
| 2011/0311910 | A1 | 12/2011 | Matsui et al. |
| 2012/0045717 | A1 | 2/2012 | Hiroko et al. |
| 2013/0164669 | A1 | 6/2013 | Yamashita et al. |
| 2015/0185658 | A1 | 7/2015 | Wakabayashi et al. |
| 2015/0227067 | A1 | 8/2015 | Hasegawa et al. |
| 2015/0227068 | A1 | 8/2015 | Sano et al. |
| 2016/0139521 | A1 | 5/2016 | Tsuda et al. |
| 2016/0154331 | A1 | 6/2016 | Tanaka et al. |
| 2016/0266509 | A1 | 9/2016 | Sano et al. |
| 2016/0378003 | A1 | 12/2016 | Arimura et al. |
| 2017/0123333 | A1 | 5/2017 | Kuroki et al. |

FOREIGN PATENT DOCUMENTS

| | | | |
|---|---|---|---|
| JP | 2003-302791 | * 10/2003 | ..... G03G 9/087 |
| JP | 2006-330706 | 12/2006 | |
| JP | 2014-071332 | 4/2014 | |

* cited by examiner

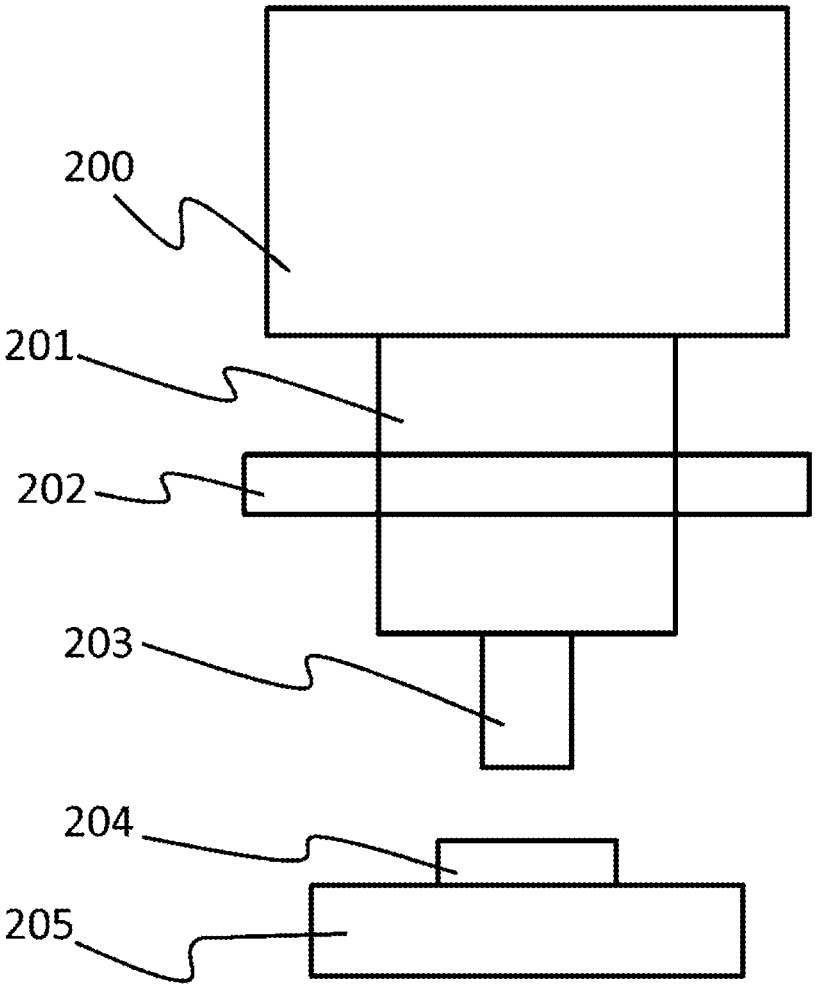
200
201
202
203
204
205

TONER

This application is a continuation of U.S. patent application Ser. No. 15/361,583 filed Nov. 28, 2016, which in turn claims the benefit of Japanese Patent Application No. 2015-237856, filed Dec. 4, 2015, and Japanese Patent Application No. 2016-174568, filed Sep. 7, 2016 which are hereby incorporated by reference herein in their entirety.

BACKGROUND OF THE INVENTION

Field of the Invention

The present invention relates to a toner suitable for a recording method using electrophotography, electrostatic recording, toner jet system recording, or the like.

Description of the Related Art

A demand for size reduction of the main body of printers and copiers has recently been created with consideration for energy and space saving. The simplification of a fixing apparatus is one of the methods for size reduction of the main body. Film fixing that enables easy simplification of a heat source and an apparatus configuration is a method for simplifying the fixing apparatus. In film fixing, in addition to easy simplification of the heat source and apparatus configuration, thermal conductivity is improved as a result of using a film as a fixing member. Therefore, a first print out time can be shortened. However, since the film is used by pressing against a roller at a relatively high pressure, the film tends to be worn down in a long-term use.

A toner demonstrating satisfactory low-temperature fixability even at a low pressure is needed to resolve this problem. However, a problem arising when the pressure at the fixing nip is reduced and images with a high print percentage are output at a high rate is that the toner tends to peel off from paper (cold offset) because of a small quantity of heat supplied to the toner as well as insufficient toner deformation.

The technique of ensuring appropriate interfacial attachment force or internal aggregation force, which are measured by specific measurement methods, has been suggested as a method for improving the cold offset resistance of toners.

Japanese Patent Application Publication No. 2006-330706 suggests a toner in which an interfacial attachment force (Fr) between the toner and polytetrafluoroethylene, which is measured by a specific measurement method, is at least 1.0 N and not more than 3.5 N and an internal aggregation force (Ft) of the toner, which is likewise measured by a specific measurement method, is at least 10 N and mot more than 18 N. Further, Japanese Patent Application Publication No. 2014-071332 suggests a toner in which an internal aggregation force (F) is at least 5 N and not more than 10 N and an interfacial attachment force (f) is at least 0.5 N and not more than 1 N, the forces being measured using specific measurement methods.

SUMMARY OF THE INVENTION

The toner disclosed in Japanese Patent Application Publication No. 2006-330706 has excellent cold offset resistance in the usual fixing device configuration. However, where images with a high print percentage are output at a high rate in addition to further reduction in pressure at the fixing nip, the toner demonstrates poor meltability under small pressurization and quantity of heat and the cold offset resistance is still insufficient.

Further, the measurements described in Japanese Patent Application Publication No. 2014-071332 involve a step of pressurizing and heating the toner, but in addition to the fact that the stage that carries the toner is heated, the quantity of heat provided to the toner over a pressurization-heating time of 30 sec deviates from the instantaneous quantity of heat provided in actual fixation. Therefore, even a toner having the abovementioned physical properties still demonstrates insufficient cold offset resistance when images with a high print percentage are output at a high rate with a fixing nip at a low pressure.

The present invention provides a toner resolving the abovementioned problems. More specifically, a toner is provided that has excellent cold offset resistance and hot offset resistance when images with a high print percentage are output at a high rate even in a fixing unit of a low pressure type.

Based on the results of comprehensive research, the inventors have found that the abovementioned problems can be resolved by using a tackiness tester and adjusting the instantaneous melting characteristic of a toner to at least a certain value and also adjusting the average circularity and softening point of the toner to certain ranges under the condition that a quantity of heat is supplied instantaneously. This finding led to the creation of the present invention.

Thus, the present invention provides a toner containing a toner particle including a binder resin, a wax, and a colorant, wherein a softening point of the toner is at least 80° C. and not more than 140° C.;

an average circularity of the toner is at least 0.940; and an integrated value of stress in the toner at 150° C. is at least 78 g·m/sec when measured using a tackiness tester on a toner pellet obtained by compressing the toner.

The present invention provides a toner that has excellent cold offset resistance and hot offset resistance when images with a high print percentage are output at a high rate even in a fixing unit of a low pressure type.

Further features of the present invention will become apparent from the following description of exemplary embodiments (with reference to the attached drawings).

BRIEF DESCRIPTION OF THE DRAWINGS

FIG. 1 is a schematic diagram of a tackiness tester for measuring the integrated value of stress.

DESCRIPTION OF THE EMBODIMENTS

The toner of the present invention contains a toner particle including a binder resin, a wax, and a colorant. Further, the specific feature of the toner is that the softening point of the toner is within a certain range and the average circularity and the integrated value of stress in the toner, which is measured by using a tackiness tester on a toner pellet obtained by compressing the toner, each are at least a certain value.

The inventors have considered the following reason why the present invention resolves the abovementioned problems. In order to obtain excellent cold offset resistance, it is important that the toner be deformed properly when receiving heat and pressure and that the surfaces of toner particles be melted and bonded together by heat. In particular, since thermal deformation of the toner is unlikely to occur in a fixing nip at a low pressure, the importance of surface binding capacity of the toner during melting is enhanced. Concerning binding strength between toner particles during melting, the binding strength increases due to the increase in the contact area of toner particles caused by instantaneous plasticization and deformation of the toner itself. In addition, there is supposedly also a relationship with surface properties of toner particles during melting.

Therefore, in order to increase the cold offset resistance at a low pressure, it is necessary to increase the binding strength between the toner particles in response to the instantaneous quantity of heat. Accordingly, the binding strength between the toner particles in response to the instantaneous heat could be increased by measuring the integrated value of stress in the toner using a tackiness tester and controlling this value.

It is important that the measurements with the tackiness tester be conducted under the following specific conditions.

Pressing temperature: 150° C.

Pressing and holding time: 1 s

Thus, it was found that the value of the integration value of stress which is strongly correlated with the cold offset resistance can be obtained by conducting measurements under the above-described conditions. Concerning the specifics, the inventors have presumed the following.

First, with respect to the pressing temperature, since the heat is taken away by continuous passage of paper media, the quantity of heat transferred to the paper, which represents the quantity of heat supplied to the toner, presumably corresponds to a temperature lower than the actual fixation set temperature. Thus, the appropriate pressing temperature is 150° C., and where the pressing temperature is higher or lower than 150° C., the correlation with the cold offset resistance in an image forming apparatus of a low-pressure system tends to be weak. In addition, assuming an actual case where the media passes through the fixing nip, it is preferred that the pressing and holding time be as short as 1 s.

Concerning the softening point of the toner, adjusting the softening point to a certain range is important for improving the cold offset resistance. Where the softening point is too low, the phenomenon that the toner peels off when image output is performed at a high temperature (hot offset) is more likely to occur, and where the softening point is too high, thermal deformation is unlikely, whereas peeling is likely to occur at a small quantity of heat.

Increasing the average circularity is also essential for obtaining excellent cold offset resistance. Where the average circularity is high, the toner on the media in high-print output can be more densely packed. As a result, gaps between the toner particles are unlikely to occur, and therefore the loss of heat is reduced and the heat is securely transferred to the toner.

It was found that, for the above reasons, where the abovementioned conditions are satisfied, a toner having excellent cold offset resistance even at a low pressure can be obtained. This finding led to the creation of the present invention. In the present invention, for example, a range with a pressure of not more than 69 kg·m/sec represents specific numerical values of the low pressure.

The present invention is described hereinbelow in greater detail, but is not limited to this description.

In the present invention, it is essential that the integrated value of stress at 150° C. be at least 78 g·m/sec when measured using a tackiness tester on a toner pellet obtained by compressing the toner. Where this value is less than 78 g·m/sec, the binding strength of the toner during melting is poor and excellent cold offset resistance at a low pressure cannot be obtained. As for the preferred range of the integrated value of stress at 150° C., where the value is at least 78 g·m/sec, the desired effect can be obtained, but when the toner is adjusted to a practicable range, while controlling the softening point to the desired range, it is preferred that the integrated value of stress be not more than 200 g·m/sec. A range of at least 80 g·m/sec and not more than 130 g·m/sec is more preferred.

A method of adjusting the thermal conductivity of the toner can be used in addition to adjusting the amount or type of the binder resin, crystalline polyester, and wax as a method for controlling the integrated value of stress in the toner at 150° C.

Further, in order to obtain the abovementioned cold offset resistance, it is essential that the softening point of the toner be at least 80° C. and not more than 140° C. and the average circularity of the toner be at least 0.940. Where the softening point is less than 80° C., the pressure increases at the nip end portion even when the fixing nip is at a low pressure. As a result, where an image is output at a high temperature, the hot offset mainly on the end portion is likely to occur. Further, where the softening point is more than 140° C., deformation in the nip portion is insufficient. As a result, the toner easily peels off from the media and the cold offset resistance tends to decrease. Therefore, the desired effect at a low pressure cannot be obtained. The softening point is preferably at least 90° C. and not more than 120° C.

Where the average circularity of the toner is less than 0.940, a large number of gaps appear between the toner particles on the media and heat is likely to dissipate. As a result, the cold offset resistance in a high-rate output tends to decrease. The upper limit of the average circularity is not particularly limited, but is usually not more than 1.00. It is more preferred that the lower limit be at least 0.950 because the heat loss caused by the abovementioned gaps between the toner particles is more easily suppressed.

The softening point of a toner can be controlled by the type or amount of a crosslinking agent. Further, when the toner is produced by the below-described suspension polymerization method, the softening point can be also adjusted by the type or amount of an initiator and a reaction temperature.

Further, the average circularity can be set in the desired range by toner production method, for example, a heat sphering treatment method after a pulverization method, or a suspension or emulsion polymerization method. In addition to adjusting the average circularity, from the standpoint of improving material dispersibility of the crystalline polyester, ester wax and so forth, which are preferably used in the present invention, it is preferred that the toner be produced by a method of suspending in an aqueous medium, more preferably by using the suspension polymerization method.

Specific materials that can be used for the toner of the present invention will be described hereinbelow.

From the standpoint of controlling the integrated value of stress to the desired value, it is preferred that the toner particle used in the present invention include a crystalline polyester.

The structure of the crystalline polyester is described below. The crystalline polyester that can be used in the present invention preferably has a substructure with a certain extent long hydrocarbon chain as a main chain. It is preferred that the crystalline polyester have the substructure represented by Formula (1) below.

Formula (1)

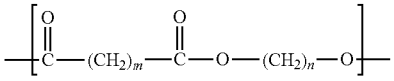

where m is an integer of 4 to 14; n is an integer of 6 to 16.

The length of the main chain is determined by the values of m and n in the substructure, and from the standpoint of encapsulating the crystalline polyester in the toner in an aqueous medium and improving storage stability, it is preferred that m be at least 4 and n be at least 6. Further, from the standpoint of increasing the solubility of the crystalline polyester itself, it is specifically preferred that m be not more than 14 and n be not more than 16. As for the substructure, from the standpoint of setting the integrated value of stress in the desirable numerical range, it is preferred that the substructure be included at at least 50 mass % with respect to the entire crystalline polyester.

A well-known crystalline polyester can be used, but a polycondensate of an aliphatic dicarboxylic acid and an aliphatic diol is preferred. A saturated Polyester is even more preferred. Examples of suitable monomers are presented below.

Examples of aliphatic dicarboxylic acids include oxalic acid, malonic acid, succinic acid, glutaric acid, adipic acid, pimelic acid, suberic acid, azelaic acid, sebacic acid, and dodecanedioic acid.

Specific examples of aliphatic diols include ethylene glycol, diethylene glycol, triethylene glycol, 1,2-propanediol, 1,3-propanediol, dipropylene glycol, trimethylene glycol, neopentyl glycol, 1,4-butanediol, 1,6-hexanediol, 1,7-heptanediol, 1,8-octanediol, 1,9-nonanediol, 1,10-decanediol, 1,11-undecanediol, and 1,12-dodecanediol.

The crystalline polyester to be used in the present invention can be produced by the usual polyester synthesis method. For example, a crystalline polyester can be obtained by performing esterification or transesterification of a dicarboxylic acid component and a dialcohol component, and then performing polycondensation by the usual method under a reduced pressure or by introducing nitrogen gas.

A usual esterification catalyst or transesterification catalyst such as sulfuric acid, tertiary butyl titanium butoxide, dibutyltin oxide, manganese acetate, and magnesium acetate can be used, as necessary, during the esterification or transesterification. Further, the polymerization can be Performed using a well-known polymerization catalyst, for example, tertiary butyl titanium butoxide, dibutyltin oxide, tin acetate, zinc acetate, tin disulfide, antimony trioxide, and germanium dioxide. The polymerization temperature and the amount of catalyst are not particularly limited and may be selected as necessary.

The catalyst is preferably a titanium catalyst, and more preferably a chelate-type titanium catalyst. This is because titanium catalysts have suitable reactivity and a polyester with a molecular weight distribution desirable in the present invention can be obtained.

The weight-average molecular weight (Mw) of the crystalline polyester is preferably at least 10,000 and not more than 40,000, and more preferably at least 10,000 and not more than 30,000. Where the weight-average molecular weight (Mw) is within the above ranges, it is possible to obtain promptly the plasticizing effect of the crystalline polyester in the fixing step, while maintaining a high degree of crystallization of the crystalline polyester.

The weight-average molecular weight (Mw) of the crystalline polyester can be controlled by a variety of production conditions of the crystalline polyester.

Further, the acid value of the crystalline polyester is preferably controlled to a low value when dispersibility in the toner is considered. Specifically, the acid value is not more than 8.0 mg KOH/g, more preferably not more than 5.0 mg KOH/g, and even more preferably not more than 3.5 mg KOH/g.

The amount of the crystalline polyester is preferably at least 1.0 part by mass and not more than 30.0 parts by mass per 100.0 parts by mass of the binder resin.

The wax is described hereinbelow.

First, in order to control the integrated value of stress to the desired value, it is preferred that the wax include an ester wax. According to the idea of the inventors relating to this feature, where an ester wax is Included in the toner, the dispersibility of the crystalline polyester in the toner is improved, and also a low-molecular component of the ester wax dissolves ahead during heating, thereby assisting the exposure of the crystalline polyester on the surface of the toner.

Further, a well-known ester wax can be used in the present invention. Suitable examples include waxes including a fatty acid ester as the main component, such as carnauba wax and montanic acid ester wax; waxes obtained by partially or entirely deoxidizing an acid component from fatty acid esters, such as deoxidized carnauba wax; methyl ester compounds having a hydroxyl group which are obtained by, for example, hydrogenation of vegetable oils and fats; saturated fatty acid monoesters such as stearyl stearate and behenyl behenate; diesterification products of saturated aliphatic dicarboxylic acids and saturated aliphatic alcohols, such as dibehenyl sebacate, distearyl dodecanedioate, and distearyl octadecanedioate; and diesterification products of saturated aliphatic diols and saturated aliphatic monocarboxylic acids, such as nonanediol dibehenate and dodecanediol distearate.

Among these waxes, from the standpoint of improving the dispersibility of the crystalline material and controlling the integrated value of stress to a more preferred value, it is preferred that a bifunctional ester wax (diester) having two ester bonds in a molecular structure be included.

Bifunctional ester waxes are ester compound of dihydric alcohols and aliphatic monocarboxylic acids or ester compound of divalent carboxylic acids and aliphatic monoalcohols.

Specific examples of the aliphatic monocarboxylic acids include myristic acid, palmitic acid, stearic acid, arachidic acid, behenic acid, lignoceric acid, cerotic acid, montanic acid, melissic acid, oleic acid, vaccenic acid, linoleic acid, and linolenic acid.

Specific examples of aliphatic monoalcohols include myristyl alcohol, cetanol, stearyl alcohol, arachidyl alcohol, behenyl alcohol, tetracosanol, hexacosanol, octacosanol and triacontanol.

Specific examples of the divalent carboxylic acids include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecanedioic acid, tetradecanedioic acid, hexadecanoic acid, octadecanoic acid, eicosanedioic acid, phthalic acid, isophthalic acid, and terephthalic acid.

Specific examples of the dihydric alcohols include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexanedimethanol, spiroglyco 1,4-phenylene glycol, bisphenol A, and hydrogenated bisphenol A.

In the present invention, waxes other than the ester waxes can be used together therewith within ranges in which the effect of the present invention is not impaired.

Well-known waxes can be used as other waxes to be combined with the ester waxes, but from the standpoint of releasability of the fixing roller and toner, aliphatic hydrocarbon waxes such as Fischer-Tropsch wax can be advantageously used.

The mass ratio (A)/(B) of the ester wax (A) and the aliphatic hydrocarbon wax (B) in the toner is preferably at least 0.25 and not more than 4.0, and more preferably at least 0.40 and not more than 2.3.

The amount of the wax is preferably at least 5.0 parts by mass and not more than 30.0 parts by mass per 100.0 parts by mass of the binder resin. Further, the amount of the ester wax is preferably at least 1.0 part by mass and not more than 30.0 parts by mass per 100.0 parts by mass of the binder resin.

Examples of the binder resin to be used in the toner of the present invention include homopolymers of styrene and substitution products thereof such as Polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins. These resins can be used individually or in combinations of a plurality thereof. Among them, from the standpoint of controlling the integrated value of stress to the desired range, styrene copolymers represented by styrene-butyl acrylate are preferred.

Styrene-acrylic resins are more preferred, examples thereof including styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer.

Examples of the colorants that can be used in the present invention include the following organic pigments, organic dyes, and inorganic pigments.

Examples of cyan colorants include copper phthalocyanine compounds and derivatives thereof, anthraquinone compounds, and basic dye lake compounds. Specific examples are presented below. C.I. Pigment Blue 1, 7, 15, 15:1, 15:2, 15:3, 15:4, 60, 62, and 66.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are presented below. C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254, and C.I. Pigment Violet 19.

Examples of yellow colorants include condensed azo compounds, isoindolinone compounds, anthraquinone compounds, azo metal complexes, methine compounds, and allylamide compounds. Specific examples are presented below. C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Examples of black colorants include carbon black and colorants toned in black by using the aforementioned yellow colorants, magenta colorants, cyan colorants, and magnetic bodies.

These colorants can be used individually or as a mixture, and also in a state of solid solution. The colorant to be used in the present invention is selected with consideration for the hue angle, chroma, lightness, lightfastness, OHP transparency, and dispersibility in the toner particle.

Among the abovementioned colorants, from the standpoint of adjusting the thermal conductivity of the toner to the desired range, a magnetic body is preferred. In terms of controlling the thermal conductivity, it is preferred that the toner of the present invention be produced in an aqueous medium.

The amount of the colorant added is preferably at least 1.0 part by mass and not more than 20.0 parts by mass per 100 parts by mass of the binder resin. When a magnetic body is used, the amount thereof is preferably at least 20.0 parts by mass and not more than 200.0 parts by mass, and more preferably at least 40.0 parts by mass and not more than 150.0 parts by mass per 100 parts by mass of the binder resin.

The value of thermal conductivity of the toner of the present invention is preferably at least 0.190 W/mK and not more than 0.300 W/mK, and more preferably at least 0.230 W/mK and not more than 0.270 W/mK. Where the thermal conductivity is at least 0.190 W/mK, heat is easily transferred between toner particles, binding capacity of the toner during melting is improved, and the toner is unlikely to peel off from the media even when the fixed image is rubbed. Further, where the thermal conductivity is not more than 0.300 W/mK, the hot offset resistance at the fixing nip end portion where the pressure is high during fixing at a high temperature is improved.

The thermal conductivity of the toner can be controlled by the amount of the magnetic body, particle size of the magnetic body, and surface treatment of the magnetic body.

When a magnetic body is used for the toner of the present invention, the magnetic body preferably includes, as the main component, a magnetic iron oxide such as triiron tetraoxide and γ-iron oxide, and may include such elements as phosphorus, cobalt, nickel, copper, magnesium, manganese, aluminum, and silicon. The BET specific surface area of these magnetic bodies determined by a nitrogen adsorption method is preferably 2 $m^2/g$ to 30 $m^2/g$, and more preferably 3 $m^2/g$ to 28 $m^2/g$. Further, the Mohs hardness is preferably 5 to 7. The shape of the magnetic body can be polyhedral, octahedral, hexahedral, spherical, acicular, and flaky, but from the standpoint of increasing the image density, shapes with a small anisotropy, such as polyhedral, octahedral, hexahedral, and spherical, are preferred.

The number-average particle diameter of the magnetic bodies is preferably 0.10 μm to 0.40 μm. Although a smaller particle size of the magnetic bodies generally results in increased tinting strength, from the standpoint of preventing the magnetic bodies from aggregation and ensuring uniform dispersion of the magnetic bodies in the toner, the abovementioned range is preferred. Where the number-average particle diameter is at least 0.10 μm, the magnetic body itself is unlikely to have a reddish black color. In particular, the reddish color is unlikely to be noticeable in half-tone images, and high-quality images can be obtained. Meanwhile, where the number-average particle diameter is not more than 0.40 μm, the tinting strength of the toner is improved and uniform dispersion is facilitated in the suspension polymerization method.

The number-average particle diameter of the magnetic bodies can be measured by using a transmission electron microscope. More specifically, the toner particles which are to be observed are sufficiently dispersed in an epoxy resin, and a cured product is then obtained by curing for 2 days in an atmosphere at a temperature of 40° C. The obtained cured product is cut with a microtome into thin samples, and the particle diameter of 100 particles of the magnetic bodies present in a field of view is measured at an image magnification of 10,000 times to 40,000 times under a transmission electron microscope (TEM). The number-average particle diameter is then calculated on the basis of the equivalent diameter of the circle equal to the projection area of the magnetic body. The particle diameter can be also measured with an image analysis device.

The magnetic body to be used in the toner of the present invention can be prepared, for example, the following method. Initially, an alkali such as sodium hydroxide is added, in an amount equivalent to, or larger than, that of the iron component, to an aqueous solution of a ferrous salt to prepare an aqueous solution of ferrous hydroxide. The air is blown into the prepared aqueous solution while maintaining the pH thereof at least 7, the oxidation reaction of the ferrous hydroxide is performed while heating the aqueous solution to at least 70° C., and seed crystals serving as cores of the magnetic iron oxide powder are initially generated.

Then, an aqueous solution including ferrous sulfate in an amount of about 1 equivalent, as determined on the basis of the previously added amount of the alkali, is added to the liquid slurry including the seed crystals. The reaction of the ferrous hydroxide is advanced while maintaining the pH of the liquid at 5 to 10 and blowing the air, and a magnetic iron oxide powder is grown on the seed crystals as cores. At this time, the shape and magnetic properties of the magnetic body can be controlled by selecting, as appropriate, the pH, reaction temperature, and stirring conditions. The pH of the liquid shifts to the acidic side as the oxidation reaction advances, but it is preferred that the pH of the liquid not be less than 5 The magnetic body can be obtained by filtering, washing, and drying, by the usual methods, the magnetic body thus obtained.

Further, when the toner is produced in an aqueous medium in the present invention, it is particularly preferred that the surface of the magnetic body be hydrophobed. Where the surface treatment is performed by a dry method, the treatment of the washed, filtered, and dried magnetic body is performed by using a coupling agent. Where the surface treatment is performed by a wet method, the dried matter is re-dispersed after completion of the oxidation reaction, or iron oxide obtained by washing and filtering is re-dispersed, without drying, in another aqueous medium after completion of the oxidation reaction, and coupling treatment is then performed. In the present invention, the dry method and wet method can be selected, as appropriate.

Examples of the coupling agents that can be used in the surface treatment of the magnetic body in the present invention include silane coupling agents, silane compounds, and titanium coupling agents. It is preferred that silane coupling agents and silane compounds be used. Examples thereof are represented by General Formula (I) below.

$$R_mSiY_n \quad (I)$$

[In the formula, R represents an alkoxy group; m represents an integer of 1 to 3; Y represents a functional group such as an alkyl group, a phenyl group, a vinyl group, an epoxy group, and a (meth)acryl group; n represents an integer of 1 to 3. However, m+n=4.]

Examples of the silane coupling agents or silane compounds represented by General Formula (I) include vinyltrimethoxysilane, vinyltriethoxysilane, vinyitris (β-methoxyethoxy)silane, β-(3,4-epoxycyclohexyl) ethyltrimethoxysilane, γ-glycidoxypropyltrimethoxvsilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxvsilane, n-decyltrimethoxysilane, hydroxypropyltrimethoxysilane, n-hexadecyltrimethoxysilane, and n-octadecyltrimethoxysilane. In the present invention, it is preferred that the compound be used in which Y in General Formula (I) is an alkyl group. Among them, from the standpoint of obtaining the desired value of thermal conductivity, it is preferred that Y be an alkyl group with a carbon number of at least 3 and not more than 6 and particularly preferably an alkyl group with a carbon number of 3 or 4.

When the silane coupling agent is used, the treatment may be performed with one agent or by using a plurality of types thereof. When the plurality of types thereof are used, the treatment may be performed with each coupling agent independently of simultaneously.

The total treatment amount of the coupling agent to be used is preferably 0.9 parts by mass to 3.0 parts by mass per 100 parts by mass of the magnetic body. The amount of the treatment agent can be adjusted according to the surface area of the magnetic body, the reactivity of the coupling agent, and the like.

In the present invention, other colorants may be used together with the magnetic bodies. Examples of colorants that can be used together with the magnetic bodies include the abovementioned well-known dyes and pigments and also magnetic and non-magnetic inorganic compounds. Specific examples include ferromagnetic metal particles such as cobalt and nickel and alloys obtained by adding chromium, manganese, copper, zinc, aluminum, and rare earth metals thereto. Particles of hematite or the like, titanium black, nigrosine dyes/pigments, carbon black, and phthalocyanine or the like can be also used. It is preferred that these colorants be further subjected to surface treatment.

The amount of the magnetic bodies in the toner can be measured using a thermal analysis device TGA 7 manufactured by PerkinElmer, Inc. The measurements are conducted in the following manner. The toner is heated from normal temperature to 900° C. at a temperature increase rate of 25° C./min under a nitrogen atmosphere. The reduction in mass (%) from 100° C. to 750° C. is taken as the binder resin amount, and the residual mass is taken as an approximate amount of magnetic bodies.

Further, the weight-average particle diameter (D4) of the toner produced according to the present invention is preferably at least 3.0 μm and not more than 12.0 μm, and more preferably at least 4.0 μm and not more than 10.0 μm. Where the weight-average particle diameter (D4) is at least 3.0 μm and not more than 12.0 μm, good flowability is obtained and a latent image can be faithfully developed.

The toner of the present invention can be also produced by heat sphering of toner particles obtained by a pulverization method, but a method for producing the toner in an aqueous medium is preferred from the standpoint of controlling the presence state of materials such as the crystalline polyester and ester wax. In particular, the suspension polymerization method is preferred because the crystalline polyester is obtained in a finely dispersed state and the advance of crystallization can be easily controlled.

The suspension polymerization method is described hereinbelow.

In the method for producing a toner by using the suspension polymerization method, a polymerizable monomer composition is obtained by uniformly dissolving or dispersing the polymerizable monomer constituting a binder resin, a wax, and a colorant (and also, if necessary, a crystalline polyester, a polymerization initiator, a crosslinking agent, a charge control agent, and other additives). Subsequent process includes a step of dispersing the polymerizable monomer composition in a continuous phase (for example, an aqueous phase) including a dispersant by using an appropriate stirrer, and forming particles of the polymerizable monomer composition in the aqueous medium, and a step of polymerizing the polymerizable monomer included in the particles of the polymerizable monomer composition. In the toner obtained by suspension polymerization method (can be referred to hereinbelow as "polymerized toner"), individual toner particles have a substantially spherical shape. As a result, the distribution of charge quantity is also relatively uniform and, therefore, image quality can be expected to improve. In the step of polymerizing the polymerizable monomer, the polymerization temperature may be set to at least 40° C. and generally to at least 50° C. and not more than 90° C.

Examples of the polymerizable monomer constituting the polymerizable monomer composition are listed below.

Thus, examples of the polymerizable monomer include styrene-based monomers such as styrene, o-methyl styrene, m-methyl styrene, p-methyl styrene, p-methoxystyrene, and p-ethylstyrene; acrylic acid ester monomers such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic acid ester monomers such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and also acrylonitrile, methacrylonitrile, and acrylamide. These monomers can be used individually or in a mixture. Among these monomers, from the standpoint of toner developing characteristic and durability, it is preferred that styrene be used individually or in a mixture with other monomers.

Polymerization initiators with a half-life of 0.5 h to 30 h in the polymerization reaction are preferred for use in the production of the toner of the Present invention by the polymerization method. Where the polymerization reaction is conducted by adding 0.5 parts by mass to 20 parts by mass of the polymerization initiator per 100 parts by mass of the polymerizable monomer, a polymer having a maximum of molecular weight between 5,000 and 50,000 can be obtained and the desirable strength and suitable melting characteristic can be imparted to the toner.

Examples of specific polymerization initiators include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethyl hexanoate, t-butyl peroxypivalate, di(2-ethylhexyl) peroxycarbonate, and di(secondary butyl) peroxycarbonate.

When the toner of the present invention is produced by the polymerization method, a crosslinking agent may be added, and the preferred added amount thereof is at least 0.001 parts by mass and not more than 15 parts by mass per 100 parts by mass of the polymerizable monomer.

Compounds having two or more polymerizable double bonds are mainly used as the crosslinking agents. Examples thereof include aromatic divinyl compounds such as divinyl benzene and divinyl naphthalene; carboxylic acid esters having two double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups. These compounds may be used individually or in combinations of two or more thereof.

When a medium which is used during the polymerization of the polymerizable monomer is an aqueous medium, a dispersion stabilizer can be used for stabilizing the particles of the polymerizable monomer composition. The following dispersion stabilizers can be used.

Examples of inorganic dispersion stabilizers include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Examples of organic dispersion stabilizers include polyvinyl alcohol, gelatin, methyl cellulose, methylhydroxypropyl cellulose, ethyl cellulose, carboxymethyl cellulose sodium salt, and starch.

Further, commercially available nonionic, anionic, and cationic surfactant can be also used. Examples of suitable surfactants include sodium dodecyl sulfate, sodium tetradecyl sulfate, sodium pentadecyl sulfate, sodium octyl sulfate, sodium oleate, sodium laurate, and potassium stearate.

When an aqueous medium is prepared using a sparingly water-soluble inorganic dispersion stabilizer in the present invention, the dispersion stabilizer is added preferably in an amount of 0.2 parts by mass to 2.0 parts by mass per 100.0 parts by mass of the polymerizable monomer. Further, it is preferred that the aqueous medium be prepared using 300 parts by mass to 3,000 parts by mass of water per 100 parts by mass of the polymerizable monomer composition.

When such an aqueous medium with a sparingly water-soluble inorganic dispersion stabilizer dispersed therein is prepared in the present invention, a commercially available dispersion stabilizer may be used as is. Further, in order to obtain a dispersion stabilizer having fine and uniform particle size, the sparingly water-soluble inorganic dispersion stabilizer may be generated under high-speed stirring in an aqueous medium such as water. More specifically, when tricalcium phosphate is used as a dispersion stabilizer, the preferred dispersion stabilizer can be obtained by mixing an aqueous sodium of sodium phosphate and an aqueous solution of calcium chloride under high-speed stirring to form fine particles of tricalcium phosphate.

In the present invention, by using the below-described method for controlling the integrated value of stress in the toner, the integrated value can be easily controlled to the above-described range.

For example, after resin particles have been obtained by polymerizing the polymerizable monomer, the dispersion in which the resin particles are dispersed in an aqueous medium is heated to a temperature above the melting points of the crystalline polyester and wax. However, when the polymerization temperature is above the melting points, this operation is not needed.

Concerning the cooling rate in the subsequent cooling step, the preferred range thereof in the present invention will be described with respect to the entire method for producing the toner, rather than only with respect to the polymerization method.

The attention is herein focused on the method for producing a toner with the object of crystallizing the crystalline substance, in particular, the crystalline polyester.

For example, when a toner is produced by a pulverization method, suspension polymerization, or emulsion polymerization, it is preferred that a step be included in which the temperature is once raised such that the crystalline polyester or wax is melted, followed by cooling to a normal temperature. Considering the cooling step, the molecular motion in the crystalline polyester liquefied by raising the temperature is attenuated as the temperature is lowered, and the crystallization starts when the crystallization temperature is approached. Where the cooling is continued, the crystallization advances and complete solidification is reached at a normal temperature. According to the study conducted by the inventors, the degree of crystallization of the crystalline substance differs depending on the cooling rate.

More specifically, where cooling is performed at a rate of at least 5.0° C./min from a temperature sufficiently high to melt the crystalline polyester and wax (for example, 100° C.) to a temperature not more than the glass transition temperature of the toner, the degree of crystallization of the included crystalline substance tends to increase. With the above-described cooling conditions, the integration value of stress in the toner is easily controlled to the above-described range.

Even more specifically, as indicated hereinabove, the sufficiently high cooling rate is a rate that is sufficiently higher than 5.0° C./min. Such cooling rate is Preferably at least 10.0° C./min, more preferably at least 30.0° C./min, and even more preferably at least 50.0° C./min. The upper limit of the cooling rate is about 3,000° C./min at which the effect thereof is saturated.

It is also preferred that the dispersion be cooled at a sufficiently high cooling rate to a temperature of not more than the glass transition temperature of the toner, then held for at least 30 min at a temperature not more than the glass transition temperature of the toner, and then cooled at a comparatively low cooling rate of not more than 1.0° C./min.

As a result of holding for at least 30 min at a temperature not more than the glass transition temperature of the toner, annealing is performed and the degree of crystallization of the crystalline polyester can be increased. The holding time is preferably at least 100 min, and more preferably at least 180 min. The upper limit of the holding time is about 1,440 min at which the effect thereof is saturated.

In the present invention, cooling at a cooling rate of not more than 1.0° C./min is called gradual cooling. As a result, the same effect as that of annealing can be obtained, the degree of crystallization of the crystalline polyester can be further increased, and the integrated value of stress in the toner is easily controlled to the above-described range. The cooling rate is preferably not more than 0.50° C./min, and more preferably not more than 0.01° C./min. The dispersion including toner particles obtained by performing the gradual cooling is filtered, washed, and dried by the conventional methods to obtain toner particles.

In the present invention, the toner particle may include a polar resin. The preferred examples of the polar resin include saturated or unsaturated polyester resins. It is also preferred that the polar resin be an amorphous resin.

Polyester resins obtained by polycondensation of the below-described carboxylic acid component and alcohol component can be used.

Examples of the carboxylic acid component include terephthalic acid, isophthalic acid, phthalic acid, fumaric acid, maleic acid, cyclohexane dicarboxylic acid, and trimellitic acid.

Examples of the alcohol component include bisphenol A, hydrogenated bisphenol, ethylene oxide adduct of bisphenol A, propylene oxide adduct of bisphenol A, glycerin, trimethylol propane, and pentaerythritol.

The polyester resin may include a urea group. In the present invention, the weight-average molecular weight (Mw) of the polar resin is preferably at least 4,000 and less than 100,000. The amount of the polar resin is preferably at least 3.0 parts by mass and not more than 70.0 parts by mass, more preferably at least 3.0 parts by mass and not more than 50.0 parts by mass, and even more preferably at least 5.0 parts by mass and not more than 30.0 parts by mass per 100 parts by mass of the binder resin.

In the present invention, the toner may include a charge control agent. Well-known charge control agents can be used. Charge control agents that enable a high charging speed and can maintain stably a constant charge quantity are particularly preferred. Further, when the toner particle is produced by a direct polymerization method, charge control agents which are substantially not solubilized with an aqueous medium and have a low polymerization inhibition ability are particularly preferred.

Charge control agents which are capable of controlling a toner particle to a negative charge are exemplified below. Thus, examples of organometallic compounds and chelate compounds include monoazo metal compounds, acetylacetone metal compounds, and metal compounds of aromatic oxycarboxylic acids, aromatic dicarboxylic acids, oxycarboxylic acids, and dicarboxylic acids. Other examples include aromatic oxycarboxylic acids, aromatic mono- and polycarboxylic acids, metal salts, anhydrides, and esters thereof, and phenol derivatives such as bisphenol. Further, urea derivatives, metal-containing salicylic acid compounds, metal-containing naphthoic acid compounds, boron compounds, quaternary ammonium salts, and calixarenes can be used.

Meanwhile, Charge control agents which are capable of controlling a toner particle to a positive charge are exemplified below. Nigrosin and nigrosin modified by fatty acid metal salts; guanidine compounds; imidazole compounds;

tributylbenzylammonium-1-hydroxy-4-naphthosulfonic acid salts; quaternary ammonium salts such as tetrabutylammonium tetrafluoroborate, onium salts such as phosphonium salts, which are analogs of the quaternary ammonium salts, and lake pigments thereof; triphenylmethane dyes and lake pigments thereof (laking agents include tungstophosphoric acid, molybdophosphoric acid, tungstomolybdophosphoric acid, tannic acid, lauric acid, gallic acid, ferricyanides, and ferrocyanides); metal salts of higher fatty acids; and resin-based charge control agents.

These charge control agents may be used individually or in combinations of two or more thereof. Among the charge control agents, metal-containing salicylic acid compounds are preferred, and compounds in which the metal is aluminum or zirconium are particularly preferred. An aluminum compound of a 3,5-di-tert-butylsalicylic acid is an even more preferred charge control agent.

Among the resin-based charge control agents, polymers having a sulfonic acid-based functional group are preferred. A polymer having a sulfonic acid-based functional group, as referred to herein, is a polymer or copolymer having a sulfonic acid group, a sulfonic acid salt group, or a sulfonic acid ester group.

Examples of the polymers or copolymers having a sulfonic acid group, a sulfonic acid salt group, or a sulfonic acid ester group include high-molecular-type compounds having a sulfonic acid group in a side chain. In particular, a high-molecular-type compound which is a styrene and/or styrene (meth)acrylic acid ester copolymer that includes a sulfonic acid group-containing (meth)acrylamide monomer at a copolymerization ratio of at least 2 mass %, preferably at least 5 mass %, and has a glass transition temperature (Tg) of 40° C. to 90° C. is preferred. In this case, charge stability under high humidity is improved.

Compounds represented by General Formula (X) below are preferred as the sulfonic acid group-containing (meth) acrylamide monomer, specific examples thereof including 2-acrylamide-2-methylpropanesulfonic acid and 2-methacrylamide-2-methylpropanesulfonic acid.

[C2]

(X)

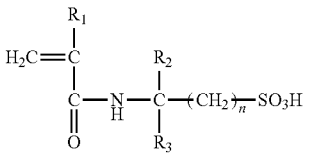

(In General Formula (X), $R_1$ represents a hydrogen atom or a methyl group; $R_2$ and $R_3$ each represent a hydrogen atom, an alkyl group, an alkenyl group, an allyl group, or an alkoxy group having a carbon number of to 10; n is an integer of 1 to 10.)

By including the polymer having a sulfonic acid group in a toner particle at at least 0.1 parts by mass and not more than 10.0 parts by mass per 100 parts by mass of the binder resin, it is possible to improve further the charge state of the toner particle.

The amount added of these charge control agents is preferably at least 0.01 parts by mass and not more than 10.00 parts by mass per 100.00 parts by mass of the binder resin.

Various organic fine powders or inorganic fine powders may be added externally to the toner particle with the object of imparting various properties.

The organic fine powder or inorganic fine powder affects surface properties and thermal melting ability of the toner particle, but it is considered that only a small effect is produced on the integrated value of stress by controlling the amount of powder added in a suitable range. Thus, from the standpoint of facilitating the adjustment of the integrated value of stress to the desired range, the amount added of the organic fine powder or inorganic fine powder is preferably at least 0.01 parts by mass and not more than 10.00 parts by mass, more preferably at least 0.02 parts by mass and not more than 5.00 parts by mass, and even more preferably at least 0.03 parts by mass and not more than 1.00 part by mass per 100.00 parts by mass of the toner particles.

The following materials can be used as the organic fine powder or inorganic fine powder.

(1) Flowability-imparting agent: silica, alumina, titanium oxide, carbon black, and carbon fluoride.

(2) Polishing agent: metal oxides such as strontium titanate, cerium oxide, alumina, magnesium oxide, and chromium oxide; nitrides such as silicon nitride; carbides such as silicon carbide; and metal salts such as calcium sulfate, barium sulfate, and calcium carbonate.

(3) Lubricant: fluororesin powders such as vinylidene fluoride and polytetrafluoroethylene, and fatty acid metal salts such as zinc stearate and calcium stearate.

(4) Charge-controlling particles: metal oxides such as tin oxide, titanium oxide, zinc oxide, silica, and alumina, and carbon black.

The organic fine powder or inorganic fine powder is used to treat the surface of toner particle to improve flowability of the toner and charging uniformity of the toner. By hydrophobing the organic fine powder or inorganic fine powder, it is possible to adjust the charging performance of the toner and improve the charging characteristic under a high-humidity environment. Therefore, it is preferred that the hydrophobed organic fine powder or inorganic fine powder be used. Examples of treatment agents for hydrophobing the organic fine Powder or inorganic fine powder include unmodified silicone varnishes, various modified silicone varnishes, unmodified silicone oil, various modified silicone oils, silane compounds, silane coupling agents, other organosilicon compounds, and or organotitanium compounds. These treatment agents may be used individually or in combinations.

Among them, inorganic fine powders treated with silicone oil is preferred. It is more preferred that an inorganic fine powder be treated with silicone oil simultaneously with hydrophobic treatment by a coupling agent or thereafter. The hydrophobed inorganic fine Powder treated with silicone oil is preferred because such powder maintains a high charge quantity of the toner even under a high-humidity environment and reduces selective developing performance. The organic fine powders or inorganic fine powders may be used individually or in combinations of a plurality thereof.

In the present invention, the BET specific surface area of the organic fine powder or inorganic fine powder is preferably at least 10 $m^2/g$ and not more than 450 $m^2/g$.

The BET specific surface area of the organic fine powder or inorganic fine powder can be determined by a low-temperature gas adsorption method realized by a dynamic constant-pressure method according to a BET method (preferably, a BET multipoint method). For example, the BET specific surface area ($m^2/g$) can be calculated by causing the sample surface to adsorb nitrogen gas and performing measurements by the BET multi-point method by using a specific surface area meter "GEMINI 2375 Ver. 5.0" (manufactured by Shimadzu Corporation).

The organic fine powder or inorganic fine powder may be strongly affixed or attached to the toner particle surface. Examples of external mixers for strongly affixing or attaching the organic fine powder or inorganic fine powder to the toner particle surface include a Henschel mixer, Mechanofusion, Cyclomix, Turbulizer, Flexomix, Hybridization, Mechanohybrid, and Nobilta. The organic fine powders or inorganic fine powders can be strongly affixed or attached by increasing the rotation peripheral speed or extending the treatment time.

The amount of tetrahydrofuran-insoluble matter (with the exception of the colorant and inorganic fine powder) in the toner of the present invention is preferably less than 50.0 mass % more preferably at least 0.0 mass % and less than 45.0 mass %, and even more preferably at least 5.0 mass % and less than 40.0 mass % relative to the toner components other than the colorant and inorganic fine powder in the toner. When the amount of tetrahydrofuran-insoluble matter is less than 50.0 mass %, the low-temperature fixability can be improved.

The amount of tetrahydrofuran-insoluble matter in the toner refers to the mass ratio of the ultra-high molecular weight polymer (substantially a crosslinked polymer) which became insoluble in the tetrahydrofuran solvent. The amount of tetrahydrofuran-insoluble matter can be adjusted by the degree of polymerization and degree of crosslinking of the binder resin.

<Method for Measuring Integrated Value of Stress in Toner>

(1) Preparation of Toner Pellet

A toner pellet is prepared by placing about 3 g of the toner (can vary depending on the specific gravity of the sample) in a vinyl chloride ring for measurements within inner diameter of 27 mm, pressing for 60 sec under 200 kN by using, for example, a sample press molding machine "MAEKAWA Testing Machine" (manufactured by MFG Co., Ltd.), and molding the sample.

(2) Measurement of Integrated Value of Stress

The integrated value of stress in the toner was measured according to a device operation manual by using a tackiness tester "TAC-1000" (manufactured by Rhesca Corporation). The schematic diagram of the tackiness tester is shown in FIG. 1.

As a specific measurement method, the toner pellet is placed on a sample pressing plate 205, and a probe tip 203 is set to 150° C. by using a probe unit 202.

By adjusting a head unit 200, the probe tip is then lowered to a position in which the probe tip can pressurize a toner pellet 204.

The toner pellet is then pressurized under the following conditions and the stress value at the time the probe tip is pulled up is detected with a load sensor 201.

Pressing rate: 5 mm/sec

Pressing load: 19.7 kg·m/sec

Pressing holding time: 1 sec

Pull-up rate: 15 mm/sec

The integrated value of stress is calculated by integrating the stress value detected by the load sensor.

More specifically, the calculation can be performed by integrating the stress value over a time interval from an instant at which a force separating the sensor from the pellet is applied (an instant at which the stress value is 0 g·m/sec$^2$) to an instant at which the sensor is separated from the pellet.

<Method for Measuring Average Circularity of Toner>

The average circulatory of toner is measured with a flow-type particle image analyzer "FPIA-3000" (manufactured by Sysmex Corporation) under the same measurement and analysis conditions as at the time of calibration operation (measurements are performed in the same manner also in the case of a magnetic toner).

The specific measurement method is as follows. Initially, about 20 mL of ion-exchanged water form which solid impurities, and the like, have been removed in advance is placed in a glass container. Then, about 0.2 mol of a diluted solution prepared by diluting "Contaminon N" (a 10 mass % aqueous solution of a neutral detergent which has pH of 7 and used for washing Precision measurement devices, the neutral detergent including a nonionic surfactant, an anionic surfactant, and an organic builder; manufactured by Wako Pure Chemical Industries, Ltd.) about three mass times with ion-exchanged water is added as a dispersant thereto. About 0.02 g of the measurement sample is then added, and dispersion treatment is performed for 2 min with an ultrasonic disperser to obtain a dispersion solution for measurements. At that time, the dispersion solution is suitably cooled such that the temperature thereof is at least 10° C. and not more than 40° C. A prescribed amount of ion-exchanged water is placed in a water tank followed by the addition of about 2 mL of the Contaminon N to the water tank by using a desktop ultrasonic cleaner/disperser having an oscillation frequency of 50 kHz and an electrical output of 150 W (for example, "VS-150" (manufactured by Velvo-Clear Co.)) as the ultrasonic disperser.

During the measurements, the aforementioned flow Particle image analyzer equipped with "UPlanApro" (magnification factor: 10 times, numerical aperture: 0.40) as an object lens was used, and a Particle Sheath "PSE-900A" (manufactured by Sysmex Corporation) was used for a sheath liquid. The dispersion solution prepared in accordance with the aforementioned procedure is introduced into the flow particle image analyzer and 3,000 toner particles are counted in the HPF measurement mode using the total count mode. The average circularity of the toner is determined by setting the binarizing threshold during particle analysis to 85% and limiting the analyzed particle diameter to a circle-equivalent diameter of at least 1.985 μm and less than 39.69 μm.

In the course of the measurements, focus is adjusted automatically using standard latex particles ("RESEARCH AND TEST PARTICLES, Latex Microsphere Suspensions 5200A" manufactured by Duke Scientific Corporation and diluted with ion-exchanged water) prior to the start of the measurements. Subsequently, focus adjustment is preferably implemented every 2 hours from the start of the measurements.

Furthermore, in the present invention, a flow particle image analyzer is used that has been calibrated by Sysmex Corporation and issued a certificate of calibration by Sysmex Corporation. The measurements were carried out under the same measurement and analysis conditions as those at the time of receiving the calibration certification, with the exception of limiting the analyzed particle diameter to a circle-equivalent diameter of at least 1.985 μm and less than 39.69 μm.

The principle of measurements with the flow-type Particle image meter "FPIA-3000" (manufactured by Sysmex Corporation) is in capturing images of a flowing particle as static images and performing image analysis. The sample added to a sample chamber is taken by a sample suction syringe and fed to a flat sheath flow cell. The sample fed to the flat sheath flow forms a flat flow sandwiched by sheath fluid. The sample passing through the flat sheath flow cell is irradiated by stroboscopic light at intervals of 1/60 sec, and images of the flowing particle can be captured as static images. Further, since the flow is flat, focused images are captured. The particle images are captured with a CCD camera and the captured images are processed at an image processing resolution of 512×512 pixels (0.37 μm×0.37 μm per pixel) and a projected area S and a perimeter L of a particle image are measured by extracting the contour of each particle image.

Next, the circle-equivalent diameter and circularity are obtained by using the area S and perimeter L. The circle-equivalent diameter refers to the diameter of a circle having the same area as the projected area of a particle image. The circularity is defined as a value obtained by dividing the perimeter of the circle obtained from the circle-equivalent diameter by the perimeter of the particle projection image and calculated by the following equation.

$$\text{Circularity}=2\times(\pi\times S)^{1/2}/L$$

When a particle image is circular, the circularity is 1.000. As the degree of unevenness of the periphery of a particle image increases, the circularity decreases. After the circularity of each particle has been calculated, the range of circularity from 0.200 to 1.000 is divided into 800 portions and an arithmetic mean value of the obtained circularities is calculated and taken as the average circularity.

<Method for Measuring Thermal Conductivity>

(1) Preparation of Measurement Sample

Two cylindrical measurement samples each having a diameter of 25 mm and a height 6 mm are prepared by compressing about 5 g of toner (the mass varies according to the specific gravity of the sample) for 60 sec under about 20 MPa by using a tablet molding compressing device under an environment at 25° C.

(2) Measurement of Thermal Conductivity

Measuring apparatus: hot-disk thermal property meter TPS 2500 S

Sample holder: sample holder for room temperature

Sensor: standard accessory (RTK) sensor

Software: Hot disk analysis 7

A measurement sample is placed on a mounting table of the sample holder for room temperature. The height of the table is adjusted such that the surface of the measurement sample is at the level of the sensor.

A second measurement sample and then a piece of accessory metal are placed on the sensor, is placed thereon, and a pressure is applied using a screw on top of the sensor. The pressure is adjusted to 30 cN·m with a torque wrench. It is confirmed that the centers of the measurement sample and the sensor are just below the screw.

The Hot disk analysis is started, and "Bulk (Type I)" is selected as the test type.

Input items are as follows.

Available Probing Depth: 6 mm

Measurement time: 40 s

Heating Power: 60 mW

Sample Temperature: 23° C.

TCR: 0.004679 $K^{-1}$

Sensor Type: Disk

Sensor Material Type: Kapton

Sensor Design: 5465

Sensor Radius: 3.189 mm

After the input, the measurements are started. After completion of the measurements, the "Calculate" button is selected, "Start Point: 10" and "End Point: 200" are input, the "Standard Analysis" button is selected, and "Thermal Conductivity" [W/mK] is calculated.

<Method for Measuring Softening Point of Toner>

The softening point of the toner determined by a flow tester temperature rise method was measured under the below-described conditions by using Flow Tester CFT-500D (manufactured by Shimadzu Corporation) in accordance with the operation manual supplied with the apparatus.

In this apparatus, a measurement sample charged in a cylinder is increased in temperature and melted while a constant load is applied with a piston from above the measurement sample, and the melted measurement sample is extruded from a die in a bottom portion of the cylinder. At this time, a flow curve representing a relationship between a piston descent amount and the temperature can be obtained.

In the present invention, a "melting temperature in a ½ method" described in the manual supplied with the apparatus was taken as a softening point. The melting temperature in the ½ method is calculated as described below.

First, ½ of a difference between a descent amount Smax of the piston at a time when the outflow is finished and a descent amount Smin of the piston at a time when the outflow is started is determined (the ½ of the difference is taken as X; X=(Smax−Smin)/2). The temperature at the flow curve when the descent amount of the piston reaches the X in the flow curve is the melting temperature in the ½ method.

Sample: the sample is obtained by weighing 1.0 g of the toner, and molding by pressurizing for 1 min under a load of 20 kN with a press-molding device with a diameter of 1 cm.

Die orifice diameter: 1.0 mm

Die length: 1.0 mm

Cylinder pressure: $9.807\times10^5$ (Pa)

Measurement mode: temperature rise method

Temperature rise rate: 4.0° C./min

With the above-described method, the obtained plunger descent amount (flow value)—temperature curve is plotted, and the softening point is measured as a temperature (the temperature at which half of the resin has flown out) corresponding to h/2, where the height of the S-shaped curve is taken as h.

EXAMPLES

The present invention will be explained hereinbelow in greater detail with reference to production examples and embodiments, but the present invention is not limited thereto. Parts and percentages in the following formulations are all on the mass basis unless specified otherwise.

<Production of Magnetic Iron Oxide 1>

An aqueous solution of a ferrous salt including ferrous hydroxide colloid was obtained by mixing and stirring 55 L of a 4.0 mol/L aqueous solution of sodium hydroxide with 50 L of an aqueous solution of ferrous sulfate including $Fe^{2+}$ at 2.0 mol/L. The resulting aqueous solution was maintained at 85° C., and an oxidation reaction was performed, while blowing air at 20 L/min, to obtain a slurry including core particles.

The resulting slurry was filtered with a filter press and washed, and the core particles were then redispersed in water and re-slurried. Magnetic iron oxide particles having a silicon-rich surface were obtained by adding sodium silicate to the re-slurried liquid at 0.20 mass %, calculated as silicon, per 100 parts of the core particles, adjusting the pH of the slurry liquid to 6.0, and stirring. The resulting slurry was filtered with a filter press, washed and then re-slurried in ion-exchanged water. A total of 500 g (10 mass % with respect to the magnetic iron oxide) of an ion-exchange resin SK110 (manufactured by Mitsubishi Chemical Corporation) was charged into the re-slurried liquid (solid fraction 50), and ion exchange was performed by stirring for 2 h. Magnetic iron oxide 1 with a number-average diameter of primary particles of 190 nm was then obtained by filtering and removing the ion-exchange resin with a mesh, filtering and washing with a filter press, drying, and pulverizing.

<Production of Magnetic Iron Oxides 2 and 3>

Magnetic ion oxides 2 and 3 were obtained in the same manner as in the production of the magnetic iron oxide 1, except that the number-average particle size of magnetic iron oxide in the production of the magnetic iron oxide 1 was adjusted. Physical properties of the obtained magnetic iron oxides 2 and 3 are shown in Table 2.

<Production of Silane Compound 1>

A total of 30 parts of iso-butyltrimethoxysilane was dropwise added to 70 parts of ion-exchanged water under stirring. The resulting aqueous solution was then held at pH 5.5 and a temperature of 55° C. and dispersed for 120 min at a circumferential rate of 0.46 m/sec by using a disper blade and hydrolyzed. The aqueous solution was then adjusted to pH 7.0 and cooled to 10° C. to stop the hydrolysis reaction. A silane compound 1 which was an aqueous solution including the hydrolysate was thus obtained.

<Production of Silane Compounds 2 and 3>

Silane compounds 2 and 3 were obtained in the same manner as the silane compound 1, except that the type of the silane compound in the production of the silane compound 1 was changed as shown in Table 1. The production conditions of the obtained silane compounds 2 and 3 are shown in Table 1.

TABLE 1

| | Type of silane compound | Temperature (° C.) | Time (min) | Carbon number | Hydrolysis ratio (%) |
|---|---|---|---|---|---|
| Silane compound 1 | iso-Butyltrimethoxysilane | 55 | 120 | 4 | 99 |
| Silane compound 2 | n-Hexyltrimethoxysilane | 55 | 120 | 6 | 99 |
| Silane compound 3 | n-Decyltrimethoxysilane | 55 | 120 | 10 | 99 |

<Production of Magnetic Body 1>

The magnetic iron oxide 1 (100 parts) was placed in a high-speed mixer (LFS-2, manufactured by Fukae Powtec Corporation), and the silane compound 1 (8.0 parts) was dropwise added over 2 min under stirring at a revolution speed of 2,000 rpm. Mixing and stirring were then Performed for 5 min. In order to increase the affixing ability of the silane compound 1, drying was then performed for 1 h at 40° C., the amount of moisture was reduced, the mixture was dried for 3 h at 110° C., and the condensation reaction of the silane compound 1 was advanced. A magnetic body 1 was then obtained by grinding and sieving through a sieve with a mesh size of 100 μm.

<Production of Magnetic Bodies 2 to 6>

Magnetic bodies 2 to 6 were produced in the same manner as in the production of the magnetic body 1, except that the magnetic iron oxide and silane compound were changed to the magnetic iron oxide and silane compound shown in Table 2.

TABLE 2

| | Magnetic iron oxide | Silane compound | Number-average particle size of magnetic body (nm) | Amount of surface silicon in magnetic iron oxide |
|---|---|---|---|---|
| Magnetic body 1 | Magnetic iron oxide 1 | Silane compound 1 | 230 | 0.2 |
| Magnetic body 2 | Magnetic iron oxide 1 | Silane compound 2 | 230 | 0.2 |
| Magnetic body 3 | Magnetic iron oxide 2 | Silane compound 2 | 280 | 0.2 |
| Magnetic body 4 | Magnetic iron oxide 1 | Silane compound 3 | 230 | 0.2 |
| Magnetic body 5 | Magnetic iron oxide 3 | Silane compound 1 | 200 | 0.2 |
| Magnetic body 6 | Magnetic iron oxide 1 | — | 200 | 0.2 |

The amount of surface silicon represents the amount of silicon (mass %) per 100 parts by mass of magnetic iron oxide.

<Production of Crystalline Polyester 1>

A total of 230.0 parts of sebacic acid as a carboxylic acid monomer and 242.1 parts of 1,10-decanediol as an alcohol monomer were charged into a reaction tank equipped with a nitrogen-introducing tube, a dehydration tube, a stirrer, and a thermocouple. The temperature was raised to 140° C. under stirring, heating to 140° C. was performed under a nitrogen atmosphere, and the reaction was conducted for 8 h under normal pressure while distilling off water. Then, tin dioctylate was added at 1 part per 100 parts by mass of the total amount of the monomers, and the reaction was then conducted while raising the temperature to 200° C. at 10° C./h. The reaction was further conducted for 2 h after the temperature of 200° C. was reached, the pressure inside the reaction tank was then reduced to not more than 5 kPa, and the reaction was conducted for 3 h at 200° C. to obtain a crystalline polyester 1. The weight-average molecular weight (Mw) of the resulting crystalline polyester 1 was 20,100 and the acid value was 2.2 mg KOH/g.

<Production of Crystalline Polyesters 2 to 8>

Crystalline polyesters 2 to 8 were obtained in the same manner as in the production of the crystalline polyester 1, except that the alcohol monomer and acid monomer were changed to those shown in Table 3. Physical properties and structure of the obtained crystalline polyesters are shown in Table 3.

TABLE 3

| Designation of crystalline polyester | Alcohol monomer: Monomer type | Alcohol monomer: Amount added (parts by mass) | Acid monomer: Monomer type | Acid monomer: Amount added (parts by mass) |
|---|---|---|---|---|
| Crystalline polyester 1 | 1,10-Decanediol | 242.1 | Decanedioic acid (sebacic acid) | 230.0 |
| Crystalline polyester 2 | 1-6-Hexanediol | 164.2 | Decanedioic acid (sebacic acid) | 230.0 |
| Crystalline polyester 3 | 1,9-Nonanediol | 202.4 | Decanedioic acid (sebacic acid) | 230.0 |
| Crystalline polyester 4 | 1,12-Dodecanediol | 281.1 | Decanedioic acid (sebacic acid) | 230.0 |
| Crystalline polyester 5 | 1,10-Decanediol | 242.1 | 1,10-Decanedicarboxylic acid (dodecanedioic acid) | 261.9 |
| Crystalline polyester 6 | 1,9-Nonanediol | 202.4 | 1,10-Decanedicarboxylic acid (dodecanedioic acid) | 261.9 |
| Crystalline polyester 7 | 1-6-Hexanediol | 164.2 | Hexanedioic acid (adipic acid) | 166.2 |
| Crystalline polyester 8 | 1,4-Butanediol | 125.2 | Hexanedioic acid (adipic acid) | 166.2 |

| | MW | Acid value (mg KOH/g) | Crystalline polyester structure: m | Crystalline polyester structure: n |
|---|---|---|---|---|
| Crystalline polyester 1 | 20100 | 2.2 | 8 | 10 |
| Crystalline polyester 2 | 20000 | 2.1 | 8 | 6 |
| Crystalline polyester 3 | 20100 | 2.0 | 8 | 9 |
| Crystalline polyester 4 | 20200 | 2.2 | 8 | 12 |
| Crystalline polyester 5 | 23000 | 2.3 | 10 | 10 |
| Crystalline polyester 6 | 22000 | 2.2 | 10 | 9 |
| Crystalline polyester 7 | 21000 | 2.1 | 4 | 6 |
| Crystalline polyester 8 | 20100 | 2.2 | 4 | 4 |

<Production of Toner Particle 1>

A total of 450 parts of a 0.1 mol/L-$Na_3PO_4$ aqueous solution was charged into 720 parts of ion-exchanged water, followed by heating to 60° C. A total of 67.7 parts of a 1.0 mol/L-$CaCl_2$ aqueous solution was then added to obtain an aqueous medium including a dispersion stabilizer.

| | |
|---|---|
| Styrene | 79.0 parts |
| n-Butyl acrylate | 21.0 parts |
| Divinylbenzene | 0.5 parts |
| Iron complex of monoazo dye (T-77, manufactured by Hodogaya Chemical Co., Ltd.) | 1.5 parts |
| Magnetic body 1 | 90.0 parts |
| Amorphous saturated polyester resin | 5.0 parts |

(amorphous saturated polyester resin obtained by a condensation reaction of terephthalic acid with an ethylene oxide (2 mol) and propylene oxide (2 mol) adduct of bisphenol A; Mw=9500, acid value=2.2 mg KOH/g, and glass transition temperature=68° C.)

The above formulation was uniformly dispersed and mixed using an attritor (Mitsui Miike Chemical Engineering Machinery Co., Ltd.), and a monomer composition was obtained. The monomer composition was heated to 63° C., and 10.0 parts of the crystalline polyester 1 presented in Table 3 and 10.0 parts of behenyl sebacate (melting point Tm: 73.0° C.) were added, mixed, and dissolved.

The monomer composition was charged into the aqueous medium and stirred at 12,000 rpm for 10 min at 60° C. with a TK-type homomixer (Tokushu Kika Kogyo Co., Ltd.) under a nitrogen atmosphere to form granules. Then, 9.0 parts of t-butylperoxvpivalate was charged as a polymerization initiator under stirring with a paddle stirring blade, and the suspension was heated to 70° C., and the reaction was conducted for 4 h at 70° C. After completion of the reaction, the suspension was heated to 100° C. and held for 120 min. Then, water at 5° C. was charged into the aqueous medium, and cooling was performed from 100° C. to 50° C. at a cooling rate of 50.0° C./min. The aqueous medium was then held for 120 min at 50° C., and then allowed to cool naturally at room temperature to 25° C. The cooling rate in this case was 1.0° C./min. Subsequent cooling, filtering, and drying produced the toner particle 1. The formulations are shown in Table 4.

<Production of Toner Particles 2 to 24>

Toner particles 2 to 24 were produced in the same manner as in the production of the toner particle 1, except that the type and number of parts of the magnetic body, type and number of parts of the crystalline polyester, type and number of parts of the ester wax, number of parts of the crosslinking agent, and cooling conditions were changed as shown in Tables 4 and 5. The formulations are shown in Table 4.

TABLE 4

| Toner particle No. | Colorant Type | Colorant Amount added (parts by mass) | Wax 1 (ester wax) Type | Wax 1 (ester wax) Amount added (parts by mass) | Wax 2 (other) Type | Wax 2 (other) Amount added (parts by mass) | Crystalline polyester Type | Crystalline polyester Amount added (parts by mass) | Crosslinking agent Amount added (parts by mass) |
|---|---|---|---|---|---|---|---|---|---|
| Toner particle 1 | Magnetic body 1 | 90.0 | Dibehenyl sebacate | 10.0 | — | — | Crystalline polyester 1 | 10.0 | 0.5 |
| Toner particle 2 | Magnetic body 1 | 70.0 | Dibehenyl sebacate | 10.0 | — | — | Crystalline polyester 1 | 10.0 | 0.5 |
| Toner particle 3 | Magnetic body 1 | 100.0 | Dibehenyl sebacate | 10.0 | — | — | Crystalline polyester 1 | 10.0 | 0.5 |
| Toner particle 4 | Magnetic body 1 | 110.0 | Dibehenyl sebacate | 10.0 | — | — | Crystalline polyester 1 | 10.0 | 0.5 |
| Toner particle 5 | Magnetic body 2 | 70.0 | Dibehenyl sebacate | 10.0 | — | — | Crystalline polyester 1 | 10.0 | 0.5 |
| Toner particle 6 | Magnetic body 3 | 50.0 | Dibehenyl sebacate | 10.0 | — | — | Crystalline polyester 1 | 10.0 | 0.5 |
| Toner particle 7 | Magnetic body 4 | 70.0 | Dibehenyl sebacate | 10.0 | — | — | Crystalline polyester 1 | 10.0 | 0.5 |
| Toner particle 8 | Magnetic body 5 | 110.0 | Dibehenyl sebacate | 10.0 | — | — | Crystalline polyester 1 | 10.0 | 0.5 |
| Toner particle 9 | Magnetic body 1 | 70.0 | Nonanediol dibehenate | 10.0 | — | — | Crystalline polyester 1 | 10.0 | 0.5 |
| Toner particle 10 | Magnetic body 1 | 70.0 | Hexanediol dibehenate | 10.0 | — | — | Crystalline polyester 1 | 10.0 | 0.5 |
| Toner particle 11 | Magnetic body 1 | 70.0 | Behenyl behenate | 10.0 | — | — | Crystalline polyester 1 | 10.0 | 0.5 |
| Toner particle 12 | Magnetic body 1 | 70.0 | Dibehenyl sebacate | 4.5 | HNP-9 | 10.5 | Crystalline polyester 1 | 10.0 | 0.5 |
| Toner particle 13 | Magnetic body 1 | 70.0 | Dibehenyl sebacate | 7.0 | HNP-9 | 3.0 | Crystalline polyester 1 | 10.0 | 0.5 |
| Toner particle 14 | Magnetic body 1 | 90.0 | Dibehenyl sebacate | 10.0 | — | — | Crystalline polyester 2 | 10.0 | 0.5 |
| Toner particle 15 | Magnetic body 1 | 90.0 | Dibehenyl sebacate | 10.0 | — | — | Crystalline polyester 3 | 10.0 | 0.5 |
| Toner particle 16 | Magnetic body 1 | 90.0 | Dibehenyl sebacate | 10.0 | — | — | Crystalline polyester 4 | 10.0 | 0.5 |
| Toner particle 17 | Magnetic body 1 | 90.0 | Dibehenyl sebacate | 10.0 | — | — | Crystalline polyester 5 | 10.0 | 0.5 |
| Toner particle 18 | Magnetic body 1 | 90.0 | Dibehenyl sebacate | 10.0 | — | — | Crystalline polyester 6 | 10.0 | 0.5 |
| Toner particle 19 | Magnetic body 1 | 90.0 | Dibehenyl sebacate | 10.0 | — | — | Crystalline polyester 7 | 10.0 | 0.5 |
| Toner particle 20 | Magnetic body 1 | 90.0 | Dibehenyl sebacate | 10.0 | — | — | Crystalline polyester 8 | 10.0 | 0.5 |
| Toner particle 21 | Magnetic body 1 | 90.0 | Dibehenyl sebacate | 10.0 | — | — | Crystalline polyester 1 | 10.0 | 0.2 |
| Toner particle 22 | Magnetic body 1 | 90.0 | Dibehenyl sebacate | 10.0 | — | — | Crystalline polyester 1 | 10.0 | 0.8 |
| Toner particle 23 | Magnetic body 1 | 90.0 | Dibehenyl sebacate | 10.0 | — | — | Crystalline polyester 1 | 25.0 | 0.5 |
| Toner particle 24 | Magnetic body 1 | 70.0 | Dibehenyl sebacate | 4.0 | HNP-9 | 10.0 | Crystalline polyester 1 | 10.0 | 0.5 |

HNP-9: paraffin wax (manufactured by Nippon Seiro Co., Ltd.)

TABLE 5

| Toner particle No. | Holding time at 100° C. after polymerization (min) | Cooling rate to temperature (50° C.) which is not more than toner Tg (° C./min) | Holding time at temperature (50° C.) which is not more than toner Tg (min) | Cooling rate from temperature (50° C.) which is not more than toner Tg to room temperature (° C./min) |
|---|---|---|---|---|
| Toner particle 1 | 120 | 50.0 | 120 | 1.0 |
| Toner particle 2 | 120 | 50.0 | 120 | 1.0 |
| Toner particle 3 | 120 | 50.0 | 120 | 1.0 |
| Toner particle 4 | 120 | 50.0 | 120 | 1.0 |
| Toner particle 5 | 120 | 50.0 | 120 | 1.0 |
| Toner particle 6 | 120 | 50.0 | 120 | 1.0 |
| Toner particle 7 | 120 | 50.0 | 120 | 1.0 |
| Toner particle 8 | 120 | 50.0 | 120 | 1.0 |
| Toner particle 9 | 120 | 50.0 | 120 | 1.0 |

TABLE 5-continued

| Toner particle No. | Holding time at 100° C. after polymerization (min) | Cooling rate to temperature (50° C.) which is not more than toner Tg (° C./min) | Holding time at temperature (50° C.) which is not more than toner Tg (min) | Cooling rate from temperature (50° C.) which is not more than toner Tg to room temperature (° C./min) |
|---|---|---|---|---|
| Toner particle 10 | 120 | 50.0 | 120 | 1.0 |
| Toner particle 11 | 120 | 50.0 | 120 | 1.0 |
| Toner particle 12 | 120 | 50.0 | 120 | 1.0 |
| Toner particle 13 | 120 | 50.0 | 120 | 1.0 |
| Toner particle 14 | 120 | 50.0 | 120 | 1.0 |
| Toner particle 15 | 120 | 50.0 | 120 | 1.0 |
| Toner particle 16 | 120 | 50.0 | 120 | 1.0 |
| Toner particle 17 | 120 | 50.0 | 120 | 1.0 |
| Toner particle 18 | 120 | 50.0 | 120 | 1.0 |
| Toner particle 19 | 120 | 50.0 | 120 | 1.0 |
| Toner particle 20 | 120 | 50.0 | 120 | 1.0 |
| Toner particle 21 | 120 | 50.0 | 120 | 1.0 |
| Toner particle 22 | 120 | 50.0 | 120 | 1.0 |
| Toner particle 23 | 120 | 50.0 | 120 | 1.0 |
| Toner particle 24 | 120 | 10.0 | 120 | 1.0 |

<Production of Toner 1>

A toner 1 was obtained by mixing the toner particles (100 parts) with 0.3 parts of hydrophobic silica and 0.1 parts of aluminum oxide with a FM Mixer (Nippon Coke & Engineering Co., Ltd.). The hydrophobic silica had a specific surface area of 200 $m^2/g$, as determined by the BET method, and the surface thereof was hydrophobed with 3.0 mass % of hexamethyldisilazane and 3 mass-% of 100-cps silicone oil. Aluminum oxide had a specific surface area of 50 $m^2/g$, as determined by the BET method. Physical properties of the toner 1 are shown in Table 6.

<Production of Toners 2 to 24>

Toners 2 to 24 were produced in the same manner as in the production of toner 1, except that the toner particles were changed as shown in Table 6. Physical properties are shown in Table 6.

<Production of Comparative Toner Particle 1>

| | |
|---|---|
| Acrylic resin (V/S-1057, manufactured by Seiko PMC Corporation) | 100.0 parts |
| Iron complex of monoazo dye (T-77, manufactured by Hodogaya Chemical Co., Ltd.) | 1.5 parts |
| Magnetic body 6 | 90.0 parts |
| Dibehenyl sebacate (melting point Tm: 73.0° C.) | 2.0 parts |
| HNP-9 (manufactured by Nippon Seiro Co., Ltd.) | 5.0 parts |
| Crystalline polyester 1 | 5.0 parts |

The abovementioned starting materials were preliminary mixed with a Mitsui Henschel Mixer (manufactured by Mitsui Miike Chemical Engineering Machinery Co., Ltd.), and then kneaded with a twin-screw kneading extruder set to 200 rpm and 130° C. The resulting mixture was rapidly cooled to normal temperature. Coarse grinding was performed with a cutter mill, and the resulting coarsely ground

TABLE 6

| | | Physical property values of toner | | | |
|---|---|---|---|---|---|
| Toner No. | Toner particle No. | Softening point (° C.) | Integrated value of stress (g · m/s) | Average circularity | Thermal conductivity (W/mK) |
| Toner 1 | Toner particle 1 | 103 | 98 | 0.980 | 0.236 |
| Toner 2 | Toner particle 2 | 101 | 108 | 0.980 | 0.230 |
| Toner 3 | Toner particle 3 | 105 | 93 | 0.980 | 0.270 |
| Toner 4 | Toner particle 4 | 107 | 89 | 0.980 | 0.274 |
| Toner 5 | Toner particle 5 | 101 | 110 | 0.970 | 0.225 |
| Toner 6 | Toner particle 6 | 101 | 110 | 0.970 | 0.189 |
| Toner 7 | Toner particle 7 | 103 | 112 | 0.960 | 0.192 |
| Toner 8 | Toner particle 8 | 109 | 87 | 0.980 | 0.289 |
| Toner 9 | Toner particle 9 | 104 | 110 | 0.980 | 0.236 |
| Toner 10 | Toner particle 10 | 102 | 104 | 0.980 | 0.236 |
| Toner 11 | Toner particle 11 | 112 | 90 | 0.980 | 0.236 |
| Toner 12 | Toner particle 12 | 106 | 80 | 0.980 | 0.236 |
| Toner 13 | Toner particle 13 | 111 | 88 | 0.980 | 0.236 |
| Toner 14 | Toner particle 14 | 104 | 100 | 0.980 | 0.236 |
| Toner 15 | Toner particle 15 | 103 | 101 | 0.980 | 0.236 |
| Toner 16 | Toner particle 16 | 108 | 95 | 0.980 | 0.236 |
| Toner 17 | Toner particle 17 | 109 | 93 | 0.980 | 0.236 |
| Toner 18 | Toner particle 18 | 105 | 94 | 0.980 | 0.236 |
| Toner 19 | Toner particle 19 | 98 | 105 | 0.980 | 0.236 |
| Toner 20 | Toner particle 20 | 96 | 110 | 0.980 | 0.236 |
| Toner 21 | Toner particle 21 | 80 | 127 | 0.980 | 0.236 |
| Toner 22 | Toner particle 22 | 139 | 88 | 0.980 | 0.236 |
| Toner 23 | Toner particle 23 | 80 | 192 | 0.980 | 0.236 |
| Toner 24 | Toner particle 24 | 106 | 78 | 0.980 | 0.236 |

material was finely pulverized by using a turbo mill T-250 (manufactured by Turbo Kogyo Co., Ltd.) and adjusting the air temperature such that the exhaust temperature was 50° C. Comparative toner particles 1 were then obtained by classification using a multi-division classifier utilizing the Coanda effect.

<Production of Comparative Toner Particles 2 to 6>

Comparative toner particles 2 to 6 were produced in the same manner as in the production of the toner particle 1, except that the type and number of parts of the magnetic body, type and number of parts of the crystalline polyester, type and number of parts of the ester wax, number of parts of the crosslinking agent, and cooling conditions were changed as shown in Table 7.

<Production of Comparative Toners 1 to 6>

Comparative toners 1 to 6 were produced in the same manner as in the production of the toner 1, except that the toner particles were changed as shown in Table 8. Physical properties are shown in Table 8.

TABLE 7

| | Colorant | | Wax | | | | Crystalline polyester | | Crosslinking agent |
|---|---|---|---|---|---|---|---|---|---|
| | | | Wax 1 (ester wax) | | Wax 2 (other) | | | | |
| Comparative toner No. | Type | Amount added (parts by mass) | Type | Amount added (parts by mass) | Type | Amount added (parts by mass) | Type | Amount added (parts by mass) | Amount added (parts by mass) |
| 1 | Magnetic body 6 | 90 | Dibehenyl sebacate | 2.0 | HNP.9 | 5.0 | Crystalline polyester 1 | 10.0 | — |
| 2 | Magnetic body 1 | 90 | Dibehenyl sebacate | 10.0 | — | — | Crystalline polyester 1 | 10.0 | 0.1 |
| 3 | Magnetic body 1 | 90 | Dibehenyl sebacate | 10.0 | — | — | Crystalline polyester 1 | 10.0 | 0.9 |
| 4 | Magnetic body 1 | 110 | Dibehenyl sebacate | 2.0 | HNP-9 | 8.0 | Crystalline polyester 1 | 10.0 | 0.5 |
| 5 | Magnetic body 1 | 90 | Dibehenyl sebacate | 10.0 | — | — | — | — | 0.5 |
| 6 | Magnetic body 1 | 70 | — | — | HNP-9 | 10.0 | Crystalline polyester 1 | 10.0 | 0.5 |
| 7 | Described in example | | | | | | | | |

| Comparative toner No. | Holding time at 100° C. after polymerization step (min) | Cooling rate to temperature (50° C.) which is not more than toner Tg (° C./min) | Holding time at temperature (50° C.) which is not more than toner Tg (min) | Cooling rate from temperature (50° C.) which is not more than toner Tg to room temperature (° C./min) |
|---|---|---|---|---|
| 1 | — | | | |
| 2 | 120 | 50.0 | 120 | 1.0 |
| 3 | 120 | 50.0 | 120 | 1.0 |
| 4 | 120 | 3.0 | 120 | 1.0 |
| 5 | 120 | 1.0 | 0 | 1.0 |
| 6 | 120 | 50.0 | 120 | 1.0 |
| 7 | Described in example | | | |

<Production of Comparative Toner 7>

(Preparation of resin particle A) Preparation of Resin Particle with a three-layer Structure A total of 8 g of sodium dodecyl sulfate was charged in 3,000 g of ion-exchanged water in a reaction vessel equipped with a stirrer, a temperature sensor, a cooling tube, and a nitrogen-introducing tube, and the internal temperature was raised to 80° C. while stirring at a stirring rate of 230 rpm under a nitrogen gas flow. After the temperature rise, a solution obtained by dissolving 10 g of potassium persulfate in 200 g of ion-exchanged water was added, the temperature was set again to 80° C., the below-described liquid monomer mixture was dropwise added over 1 h, and polymerization was then Performed by heating for 2 h at 80° C. under stirring to prepare resin particles. These particles are referred to as "resin particles (1H)".

| | |
|---|---|
| Styrene | 480.0 g |
| n-Butyl acrylate | 250.0 g |
| Methacrylic acid | 68.0 g |
| n-Octyl-3-mercaptopropionate | 16.0 g |

A dispersion solution including emulsified particles (oil droplets) was prepared by charging a solution obtained by dissolving 7 g of polyoxyethylene (2) sodium dodecyl ether sulfate in 800 g of ion-exchanged water in a reaction vessel equipped with a stirrer, a temperature sensor, a cooling tube, and a nitrogen-introducing tube, heating to 98° C., then adding 260 g of the resin particles (1H) and a solution obtained by dissolving the below-described monomer solution at 90° C., and mixing and dispersing for 1 h with a mechanical disperser "CLEARMIX" manufactured by M Technique Co., Ltd.) having a circulation path.

| | |
|---|---|
| Styrene | 245.0 g |
| n-Butyl acrylate | 120.0 g |
| n-Octyl-3-mercaptopropionate | 1.5 g |
| Polyethylene wax (melting point: 80° C.) | 190.0 g |

A polymerization initiator solution prepared by dissolving 6 g of potassium persulfate in 200 g of ion-exchanged water was then added to the dispersion solution, polymerization was performed by heating and stirring the system for 1 h at 82° C., and resin particles were obtained. These particles are referred to as "resin particles (1HM)".

A solution prepared by dissolving 11 g of potassium persulfate in 400 g of ion-exchanged water was further added, and a liquid mixture including the following monomers was dropwise added over 1 h under a temperature condition of 82° C.

| | |
|---|---|
| Styrene | 435.0 g |
| n-Butyl acrylate | 130.0 g |
| Methacrylic acid | 33.0 g |
| n-Octyl-3-mercaptopropionate | 8.0 g |

Upon completion of the dropwise addition, the polymerization was performed by heating and stirring for 2 h, and the system was then cooled to 28° C. to obtain resin particles. These particles are referred to as "resin particles A". The Tg of the resin particle A was 48° C. and the softening point was 88° C.

(Preparation of Resin Particle B)

A total of 2.3 g of sodium dodecyl sulfate was charged in 3,000 g of ion-exchanged water in a reaction vessel equipped with a stirrer, a temperature sensor, a cooling tube, and a nitrogen-introducing tube, and the internal temperature was raised to 80° C. while stirring at a stirring rate of 230 rpm under a nitrogen gas flow. After the temperature rise, a solution obtained by dissolving 10 g of potassium persulfate in 200 g of ion-exchanged water was added, the liquid temperature was set again to 80° C., the below-described liquid monomer mixture was dropwise added over 1 h, and polymerization was then Performed by heating for 2 h at 80° C. under stirring to prepare resin particles. These particles are referred to as "resin particles B".

| | |
|---|---|
| Styrene | 520.0 g |
| n-Butyl acrylate | 210.0 g |
| Methacrylic acid | 68.0 g |
| n-Octyl-3-mercaptopropionate | 16.0 g |

(Preparation of Colorant-Dispersed Solution)

A total of 90 g of sodium dodecyl sulfate was stirred and dissolved in 1,600 g of ion-exchanged water. A total of 420 g of carbon black was gradually added while stirring the solution. A dispersion solution of colorant particles was then prepared by dispersing with the disperser "CLEARMIX" (manufactured by M Technique Co., Ltd.). This solution is referred to as "colorant-dispersed solution".

(Aggregation and Melt Adhesion Step)

A total of 300 g, calculated as solids, of the resin particles A, 1,400 g of ion-exchanged water, 120 g of the "colorant-dispersed solution", and a solution prepared by dissolving 3 g of polyoxyethylene (2) sodium dodecyl ether sulfate in 120 g of ion-exchanged water were charged into a reaction vessel equipped with a stirrer, a temperature sensor, a cooling tube, and a nitrogen-introducing device, and the liquid temperature was adjusted to 30° C. The pH was then adjusted to 10 by adding a 5N aqueous solution of sodium hydroxide. Then, an aqueous solution prepared by dissolving 35 g of magnesium chloride in 35 g of ion-exchanged water was added over 10 min at 30° C. under stirring. After holding for 3 min, the temperature rise was started, the system temperature was raised to 90° C. over 60 min, and the particle growth reaction was continued while keeping the temperature at 90° C.

In this state, the diameter of associated particles was measured with "Coulter Multisizer III" (manufactured by Beckman Coulter, Inc.), and when the median particle diameter (D50), based on the volume standard, became 3.1 μm, 260 g of resin particles B were added and the particle growth reaction was further continued. When the desired particle diameter was reached, an aqueous solution obtained by dissolving 150 g of sodium chloride in 600 g of ion-exchanged water was added to stop the particle growth. Then, in the melt adhesion step, melt adhesion of the particles was advanced by heating and stirring at a liquid temperature of 98° C. till a circularity of 0.96, as measured with "FPIA-3000" (manufactured by Sysmex Corporation), was obtained. Cooling to a liquid temperature of 30° C. was then performed, pH was adjusted to 4.0 by adding hydrochloric acid, and stirring was stopped.

(Washing and Drying Step)

The particles prepared in the aggregation and melt adhesion step were solid-liquid separated with a basket-type centrifugal separator "MARK Type-III, No. 60×40" (manufactured by Matsumoto Kikaki Co., Ltd.) and a wet cake of toner base particles was formed. The wet cake was washed with water in the basket-type centrifugal separator till the electric conductivity of the filtrate became 5 μS/cm, and the cake was then transferred to a "Flash Jet Dryer" (manufactured by Seishin Enterprise Co., Ltd.) and dried to a moisture amount of 0.5 mass % to produce toner base particles with a median particle diameter (D50), based on the volume standard, of 6.2

(External Additive Addition Step)

A total of 1 mass % of hydrophobic silicon oxide (number-average diameter of primary particles=12 nm, hydrophobicity=68) and 0.3 mass % of hydrophobic titanium oxide (number-average diameter of primary particles=20 nm, hydrophobicity=63) were added to the obtained toner base particles and mixed with a Mitsui Henschel Mixer (manufactured by Mitsui Miike Chemical Engineering Machinery Co., Ltd.) to prepare comparative toner 7. Physical properties of the comparative toner 7 are shown in Table 8.

TABLE 8

| | | Physical property values of toner | | | |
|---|---|---|---|---|---|
| Toner No. | Toner particle No. | Softening point (° C.) | Integral value of stress (g · m/s) | Average circularity | Thermal conductivity (W/mK) |
| Comparative toner 1 | Comparative toner particle 1 | 105 | 79 | 0.930 | 0.189 |
| Comparative toner 2 | Comparative toner particle 2 | 74 | 135 | 0.980 | 0.236 |
| Comparative toner 3 | Comparative toner particle 3 | 146 | 88 | 0.980 | 0.236 |
| Comparative toner 4 | Comparative toner particle 4 | 106 | 72 | 0.980 | 0.236 |
| Comparative toner 5 | Comparative toner particle 5 | 125 | 19 | 0.980 | 0.234 |

TABLE 8-continued

| Toner No. | Toner particle No. | Physical property values of toner | | | |
|---|---|---|---|---|---|
| | | Softening point (° C.) | Integral value of stress (g · m/s) | Average circularity | Thermal conductivity (W/mK) |
| Comparative toner 6 | Comparative toner particle 6 | 115 | 19 | 0.980 | 0.232 |
| Comparative toner 7 | Comparative toner particle 7 | 121 | 60 | 0.960 | 0.145 |

Example 1

A printer LBP3100 (manufactured by Canon Inc.) was modified and used for print-out evaluation. The modifications involved increasing the process speed from the conventional to 200 mm/sec and decreasing the contact pressure of the fixing film and pressurizing roller to 69 kg·m/sec. The modification was also performed such that the fixing temperature of the fixing unit in the modified LBP3100 could be adjusted.

<Evaluation of Fixing>

Cold offset resistance in the above-described image forming apparatus was evaluated under a normal-temperature and normal-pressure environment (temperature 25.0° C. and humidity 50% RH). FOX RIVER BOND paper (110 g/m$^2$) was used for fixing medium. By using the medium in the form of thick paper with a comparatively large surface unevenness, it was possible to evaluate rigorously the fixing performance under facilitated peeling and rubbing conditions.

(Cold Offset Resistance)

The carried amount of the toner on the fixing medium was adjusted to 0.90 mg/cm$^2$. The fixing unit was then cooled to room temperature (15° C.), a solid image was printed continuously 20 times, the heater temperature of the fixing unit was set at random within a range of at least 190° C. and not more than 250° C. (referred to hereinbelow as fixing temperature), and fixing was performed. Cold offset was visually determined in the 20 printed images and evaluated according to the following determination criteria.

A: cold offset does not occur at a temperature up to 200° C.

B: cold offset occurs at a temperature of at least 200° C. and less than 210° C.

C: cold offset occurs at a temperature of at least 210° C. and less than 220° C.

D: cold offset occurs at a temperature of at least 220° C.

(Rubbing Test)

A half-tone image density was adjusted such that the image density (measured using a Macbeth reflection densitometer (manufactured by Macbeth Co.) on the fixing medium was at least 0.75 and not more than 0.80, and imaging was performed at a fixing temperature of 150° C.

Then, the fixed half-tone image was rubbed 10 times with lens-cleaning paper to which a load of 55 g/cm$^2$ was applied. The density reduction rate at 150° C. was calculated by using the following equation from the half-tone image density before and after the rubbing.

Density reduction rate (%)=[(Image density before rubbing)−(Image density after rubbing)]/(Image density before rubbing)×100

The density reduction rate was similarly calculated by increasing the fixing temperature by 5° C. to 200° C. A temperature at which the density reduction rate becomes 15% was calculated from the evaluation results on the fixing temperature and density reduction rate, which were obtained by the series of operations, and the calculated temperature was taken as a fixing low limit temperature indicating a threshold at which the low-temperature fixing performance is satisfactory.

A: fixing low limit temperature is less than 160° C.

B: fixing low limit temperature is at least 160° C. and less than 170° C.

C: fixing low limit temperature is at least 170° C. and less than 180° C.

D: fixing low limit temperature is at least 180° C.

(Hot Offset Resistance)

In the evaluation of hot offset resistance, a half-tone image with a height of 2.0 cm and a width of 15.0 cm was formed on 90 g/m$^2$ paper of an A4 size in a portion at 2.0 cm from the upper end portion and a portion at 2.0 cm from the lower end portion with respect to the paper passage direction under a normal-temperature and normal-pressure environment (temperature 25° C. and humidity 50% RH). In the imaging, the image density measured using a Macbeth reflection densitometer (manufactured by Macbeth Co.) was adjusted to at least 0.75 and not more than 0.80. The imaging was performed by raising the set temperature of the fixing unit by 5° C. from 170° C. The evaluation was performed visually according to the following determination criteria.

A: hot offset does not occur at a temperature up to 200° C.

B: hot offset occurs at a temperature of at least 190° C. and less than 200° C.

C: hot offset occurs at a temperature of at least 180° C. and less than 190° C.

D: hot offset occurs at a temperature less than 180° C.

<Evaluation of Storage Stability>

(Evaluation of Long-Term Storability)

A total of 10 g of the toner 1 was placed in a 100 mL glass bottle, allowed to stand for 3 months at a temperature of 45° C. and a humidity of 95%, and visually evaluated.

A: no changes

B: aggregates are formed, but immediately loosened

C: aggregates which are unlikely to loosen are formed

D: no flowability

E: caking clearly occurs

Examples 2 to 24

The evaluation was performed in the same manner as in Example 1, except that toners 2 to 24 were used. The evaluation results are shown in Table 9.

Comparative Examples 1 to 7

The evaluation was performed in the same manner as in Example 1, except that comparative toners 1 to 7 were used. The evaluation results are shown in Table 9.

TABLE 9

| | Toner | Fixing performance | | | Long-term storability |
|---|---|---|---|---|---|
| | | Cold offset (° C.) | Rubbing test (° C.) | Hot offset (° C.) | |
| Example 1 | Toner 1 | A (190) | A (150) | A (200) | A |
| Example 2 | Toner 2 | A (190) | A (150) | A (200) | A |
| Example 3 | Toner 3 | A (190) | A (150) | A (200) | A |
| Example 4 | Toner 4 | A (195) | A (150) | A (200) | A |
| Example 5 | Toner 5 | A (195) | A (150) | A (200) | A |
| Example 6 | Toner 6 | B (200) | B (160) | A (200) | A |
| Example 7 | Toner 7 | B (205) | A (155) | A (200) | A |
| Example 8 | Toner 8 | A (195) | A (155) | A (200) | A |
| Example 9 | Toner 9 | A (190) | A (150) | A (200) | A |
| Example 10 | Toner 10 | A (190) | A (150) | A (200) | A |
| Example 11 | Toner 11 | B (200) | B (160) | A (200) | A |
| Example 12 | Toner 12 | B (200) | B (160) | A (200) | A |
| Example 13 | Toner 13 | A (195) | A (150) | A (200) | A |
| Example 14 | Toner 14 | A (190) | A (150) | A (200) | A |
| Example 15 | Toner 15 | A (190) | A (150) | A (200) | A |
| Example 16 | Toner 16 | A (190) | A (150) | A (200) | A |
| Example 17 | Toner 17 | A (190) | A (150) | A (200) | A |
| Example 18 | Toner 18 | A (190) | A (150) | A (200) | A |
| Example 19 | Toner 19 | A (190) | A (150) | A (200) | A |
| Example 20 | Toner 20 | A (190) | A (150) | A (200) | B |
| Example 21 | Toner 21 | A (190) | A (150) | B (190) | B |
| Example 22 | Toner 22 | C (210) | C (170) | A (205) | A |
| Example 23 | Toner 23 | A (190) | A (150) | C (185) | B |
| Example 24 | Toner 24 | C (215) | C (170) | A (200) | A |
| Comparative Example 1 | Comparative toner 1 | D (220) | C (175) | A (200) | A |
| Comparative Example 2 | Comparative toner 2 | A (190) | A (150) | D (175) | C |
| Comparative Example 3 | Comparative toner 3 | D (220) | D (180) | A (200) | A |
| Comparative Example 4 | Comparative toner 4 | D (220) | D (180) | A (200) | A |
| Comparative Example 5 | Comparative toner 5 | D (225) | D (180) | A (200) | A |
| Comparative Example 6 | Comparative toner 6 | D (220) | D (180) | A (200) | A |
| Comparative Example 7 | Comparative toner 7 | D (225) | D (180) | A (200) | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A toner comprising a toner particle including a binder resin, a wax, and a colorant, wherein the wax comprises an ester wax, the ester wax being (i) an ester compound of a dihydric alcohol and an aliphatic monocarboxylic acid, or (ii) an ester compound of a divalent carboxylic acid and an aliphatic monoalcohol, a softening point of the toner is 80 to 140° C.;

an average circularity of the toner is at least 0.940; and an integrated value of stress in the toner at 150° C. is at least 80 g·m/sec when measured using a tackiness tester on a toner pellet obtained by compressing the toner.

2. The toner according to claim 1, wherein the binder resin is a styrene-acrylic resin.

3. The toner according to claim 1, wherein the colorant is a magnetic body.

4. The toner according to claim 1, wherein a thermal conductivity of the toner is 0.190 to 0.300 W/mK.

5. The toner according to claim 1, wherein the average circularity of the toner is at least 0.950.

6. The toner according to claim 1, wherein the integrated value of stress in the toner at 150° C. is 80 g·m/sec to 130 g·m/sec.

7. The toner according to claim 1, wherein the wax consists of the ester wax.

* * * * *